US006420833B2

(12) United States Patent
Simpelaar

(10) Patent No.: US 6,420,833 B2
(45) Date of Patent: Jul. 16, 2002

(54) SWITCHING DEVICE WITH IMPROVED OVER-CURRENT PROTECTION

(75) Inventor: Bennie Izaak Pieter Simpelaar, Terneuzen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/778,263

(22) Filed: Feb. 7, 2001

(30) Foreign Application Priority Data

Feb. 10, 2000 (EP) ..... 00200440

(51) Int. Cl.[7] ..... H01J 13/32

(52) U.S. Cl. ..... 315/112; 315/118; 315/209 R; 315/58; 315/61; 315/DIG. 5

(58) Field of Search ..... 315/209 R, 291, 315/307, 244, 209 CD, 227 R, 112, 118, 58, 61, 72, DIG. 5, DIG. 7

(56) References Cited

U.S. PATENT DOCUMENTS 4,647,817 A * 3/1987 Fahnrich et al. ..... 315/104
5,086,249 A * 2/1992 Blaisdell et al. ..... 313/318
5,521,467 A * 5/1996 Statnic et al. ..... 315/247
5,550,437 A * 8/1996 Hopkins et al. ..... 315/209 R
5,719,473 A * 2/1998 Huber et al. ..... 315/247
5,828,187 A * 10/1998 Fischer ..... 315/291
5,828,188 A * 10/1998 Lecheler ..... 315/309
6,188,184 B1 * 2/2001 Eberson et al. ..... 315/307

FOREIGN PATENT DOCUMENTS

| | | |
|---|---|---|
| DE | 2539543 | 3/1977 |
| DE | 2641970 | 3/1978 |
| DE | 3221919 A1 | 12/1983 |
| GB | 1493287 | 11/1977 |

* cited by examiner

*Primary Examiner*—Haissa Philogene

(57) ABSTRACT

In an electronic ballast comprising a fusistor for switching off the ballast if the mains supply current becomes too high, an NTC is arranged between the mains supply lines. A very reliable functioning of the fusistor is obtained thereby.

3 Claims, 2 Drawing Sheets

SWITCHING DEVICE WITH IMPROVED OVER-CURRENT PROTECTION

BACKGROUND OF THE INVENTION

The invention relates to a switching device for energizing a lamp, comprising a first input terminal and a second input terminal, which are to be connected to a supply-voltage source, a ballast circuit for generating a current from a supply voltage supplied by the supply-voltage source, which current flows through the lamp, a first input of the ballast circuit being connected to the first input terminal by means of a first branch comprising a fusistor, and a second input of the ballast circuit being connected to the second input terminal by means of a second branch. The invention also relates to a compact lamp.

Such a switching device is well-known. The fusistor in the known switching device protects the ballast circuit by becoming non-conducting when the current in the first branch becomes too high. Such an excessively high current may be caused, for example, by transients on the supply voltage or by a short-circuit in the ballast circuit. The operation of the fusistor is based on the fact that, in the event of too high a current, the development of heat in the fusistor leads to the melting of a fuse wire forming part of the fusistor, causing the conducting connection between the ends of the fusistor to be interrupted. The fusistor is more reliable as the current in the first branch is higher. In practice it has been found, however, that the fusistor remains conducting within a certain range of the effective value of the current in the first branch, which does lead to damage to the ballast circuit. The heat generated inside the fusistor is dissipated rapidly enough to preclude melting of the fuse wire. Since the fusistor remains conducting under these circumstances, the ballast circuit is not protected against currents that lie in the above-mentioned range.

SUMMARY OF THE INVENTION

Therefore, it is an object of the invention to provide a switching device wherein the ballast circuit is effectively protected in a very large range of the effective value of the current in the first branch.

To achieve this, a switching device of the type mentioned in the opening paragraph is characterized in accordance with the invention in that the first input and the second input of the ballast circuit are interconnected by means of a third branch, which does not form part of the ballast circuit and which comprises an NTC resistor.

The NTC resistor is dimensioned such that the third branch carries only a small amount of current during stationary operation. However, if the current in the first branch of a switching device in accordance with the invention increases, for example as a result of a temporarily comparatively high value of the supply voltage, the current in the third branch increases too. This current increase in the third branch causes the temperature of the NTC resistor to increase, as a result of which the impedance decreases. This decrease in impedance causes a further increase of the current in the third branch, as a result of which the temperature of the NTC resistor exhibits a further increase and the impedance decreases. If the value of the supply voltage still is comparatively high, this decrease of the impedance of the third branch causes the current in the fusistor to increase to a value such that the fuse wire melts and hence the fusistor becomes non-conducting.

By arranging the NTC resistor such that the temperature of the NTC resistor is influenced by the temperature of the ballast circuit, it can be achieved that also an increase of said temperature, for example caused by a defect of one of the components, causes the fusistor to become non-conducting.

The ballast circuit in a switching device in accordance with the invention preferably comprises

- a rectifier for rectifying the supply voltage, and
- a DC-AC converter for generating a high-frequency lamp current from the rectified supply voltage.

As such switching devices are generally embodied so as to be very compact, the temperature of the ballast circuit may increase, for various reasons, to a value which is so high that damage to components of the ballast circuit occurs. In a switching device in accordance with the invention, the ballast circuit can be protected against such a temperature by suitably arranging the NTC resistor.

For the reason mentioned hereinabove, a switching device in accordance with the invention can also very suitably be used in the electronic ballast of a compact lamp comprising

- a light-transmitting discharge vessel provided with an inert gas-containing filling and two electrodes,
- a lamp housing secured to the discharge vessel,
- a lamp cap which is provided with electrical contacts and secured to the lamp housing,
- and an electronic ballast coupled between the electrodes and the contacts for generating a lamp current from a supply voltage.

As the switching device must be embodied so as to be very compact, and the switching device is accommodated in a housing in the form of the lamp housing, it is very necessary to effectively protect the switching device against excessively high temperatures.

These and other aspects of the invention will be apparent from and elucidated with reference to the embodiment(s) described hereinafter.

BRIEF DESCRIPTION OF THE DRAWING

In the drawing:

In FIG. 1, K1 and K2 are, respectively, a first and a second input terminal, which are to be connected to a supply-voltage source. Input terminal K1 is connected by means of a fusistor F to a first input of a rectifier GM which, in this example, is formed by a diode bridge. In this example, the fusistor F forms a first branch. Input terminal K2 is connected to a second input of rectifier GM. This connection constitutes a second branch. The first input of the rectifier is connected to the second input of the rectifier by means of a NTC resistor which, in this example, forms a third branch. Output terminals of the rectifier GM are interconnected by means of a capacitor C1. Capacitor C1 is shunted by a series arrangement of a first switching element S1 and a second switching element S2. Respective control electrodes of the first switching element S1 and the second switching element S2 are connected to respective outputs of a control circuit Sc1 for rendering the first and the second switching element alternately conducting and non-conducting. The second switching element S2 is shunted by a series arrangement of coil L1, lamp connection terminal K3, lamp La, lamp connection terminal K4 and capacitor C2. The lamp La is shunted by capacitor C3. In this example, the control circuit Sc1, the switching elements S1 and S2, coil L1, lamp connection terminals K3 and K4, and capacitors C2 and C3 jointly form a DC-AC converter for generating a high-frequency lamp current from the rectified supply voltage present between the output terminals of the rectifier GM. The NTC resistor NTC is arranged in the direct vicinity of the switching elements.

Figure 1:
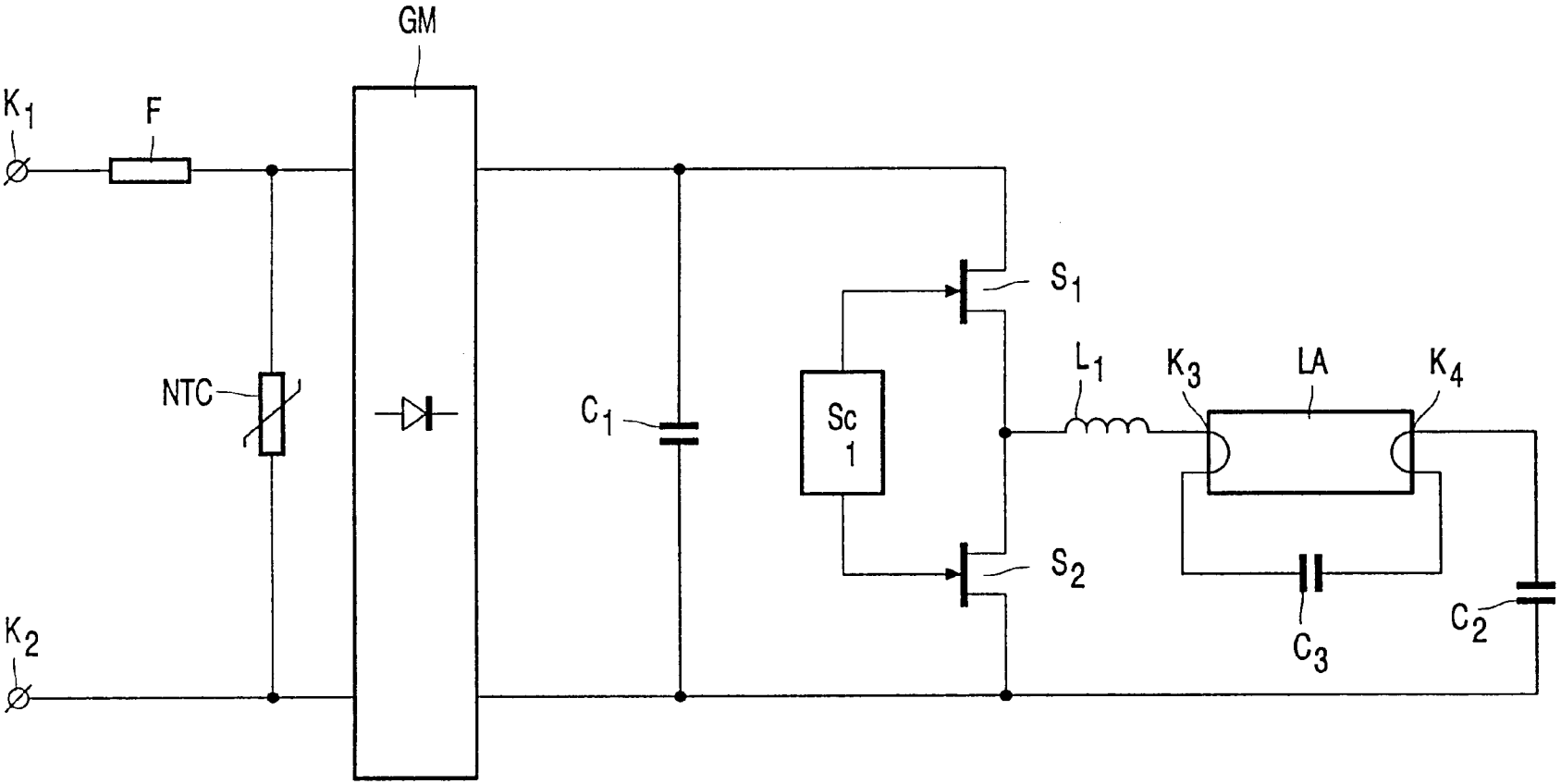
FIG. 1 shows an example of a switching device in accordance with the invention, to which a lamp La is connected.

The operation of the example shown in FIG. 1 is as follows.

If the input terminals K1 and K2 are connected to the poles of a supply-voltage source, the control circuit Sc1 renders the switching elements S1 and S2 alternately conducting and nonsconducting. As a result, a substantially square-wave high-frequency voltage is applied to a junction point of the two switching elements. As a result of this substantially square-wave high-frequency voltage, a high-frequency current flows in the load branch of the DC-AC converter, which is formed by the coil L1, lamp La, the lamp connection terminals K3 and K4 and the capacitors C2 and C3. By virtue thereof, also a high-frequency current flows through the lamp La. If the temperature of one of the switching elements increases excessively, for example as a result of a defect, the temperature of the NTC resistor NTC increases too. As a result, the impedance of the NTC resistor decreases and hence the current through the fusistor increases such that this fusistor becomes non-conducting. In this manner, the ballast circuit formed, in this example, by the rectifier GM and the DC-AC converter is effectively protected against an excessively high temperature.

Figure 2:
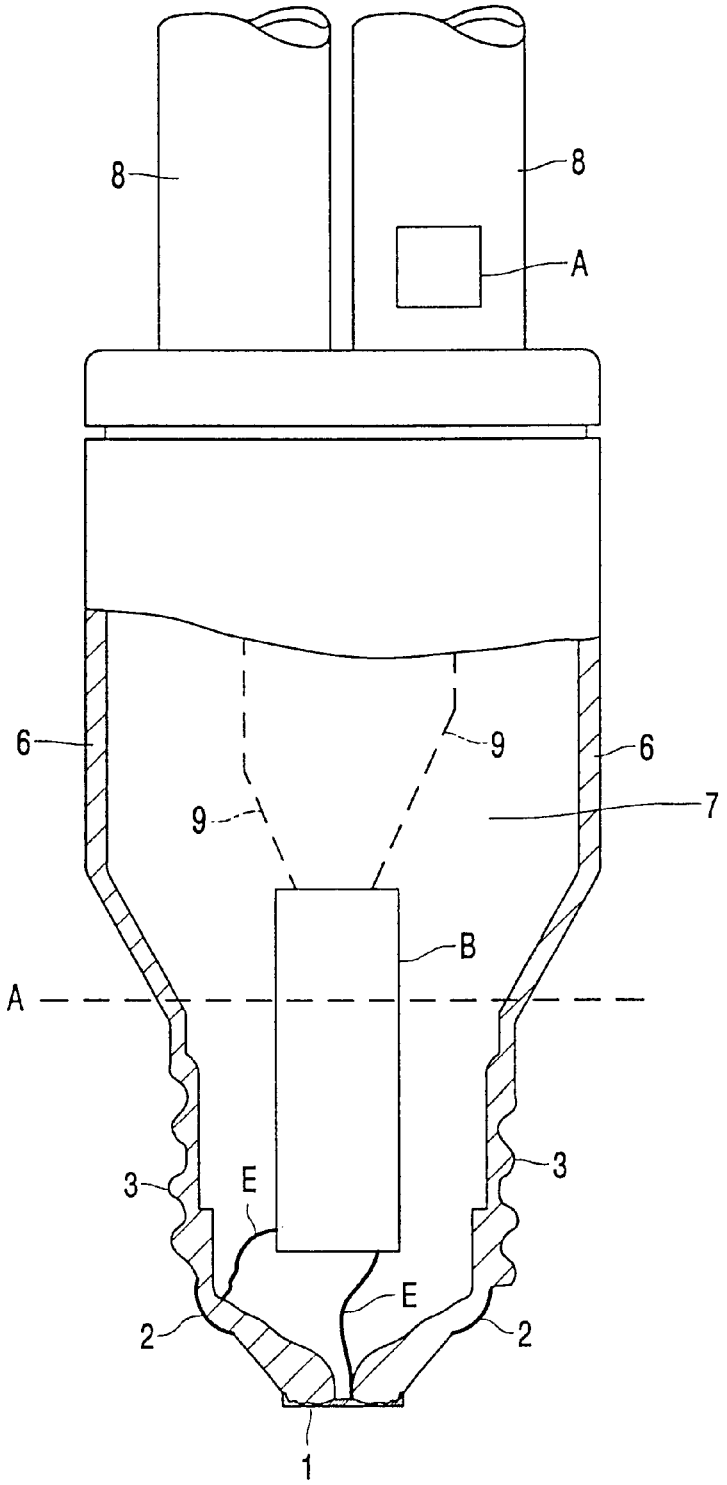
FIG. 2 shows an example of a compact lamp in accordance with the invention.

In FIG. 2, reference numeral 8 denotes a light-transmitting discharge vessel provided with a filling containing mercury and an inert gas, and with two electrodes (not shown). A luminescent layer is applied to the wall of the discharge vessel. Reference numeral 6 denotes a lamp housing which is secured to the discharge vessel 8, and reference numeral 3 denotes a lamp cap provided with electric contacts (1 and 2), which is secured to the lamp housing. B denotes a diagrammatic representation of a switching arrangement in accordance with the invention, which is coupled between the contacts (1, 2) via the conductors (E) and the electrodes (via conductors 9) and which is used for generating a high-frequency lamp current.

What is claimed is:

1. Apparatus for energizing a lamp comprising:

a. first and second input terminals for connection to a supply-voltage source;

b. ballast circuitry for generating a current for powering the lamp from a supply voltage provided by the supply-voltage source, said ballast circuitry having first and second inputs;

c. overcurrent protection circuitry comprising:

i. a first branch including a fusistor for electrically connecting said first input to the first input terminal;

ii. a second branch for electrically connecting said second input to the second input terminal;

iii. a third branch including an NTC resistor for electrically connecting the first input to the second input.

2. Apparatus as in claim 1 wherein the ballast circuitry comprises:

a. a rectifier for rectifying the supply voltage;

b. a DC-AC converter for generating a high-frequency lamp current from the rectified supply voltage.

3. A compact lamp comprising:

a. a light-transmissive discharge vessel containing an inert gas and having first and second vessel electrodes;

b. a lamp housing secured to the discharge vessel;

c. first and second contacts for connection to a supply voltage source;

d. ballast circuitry for connection to the first and second vessel electrodes to generate a current for powering the compact lamp from a supply voltage provided by the supply-voltage source, said ballast circuitry having first and second inputs;

e. overcurrent protection circuitry comprising:

i. a first branch including a fuisistor for electrically connecting said first input to the first contact;

ii. a second branch for electrically connecting said second input to the second contact;

iii. a third branch including an NTC resistor for electrically connecting the first input to the second input.

* * * * *